US008505567B1

(12) United States Patent
Wu

(10) Patent No.: US 8,505,567 B1
(45) Date of Patent: Aug. 13, 2013

(54) MOUNTING MECHANISM OF A SHOWER EQUIPMENT

(76) Inventor: Chao-Chung Wu, Taichung (TW)

( * ) Notice: Subject to any disclaimer, the term of this patent is extended or adjusted under 35 U.S.C. 154(b) by 0 days.

(21) Appl. No.: 13/553,749

(22) Filed: Jul. 19, 2012

(51) Int. Cl.
*G05D 11/00* (2006.01)

(52) U.S. Cl.
USPC ..... 137/119.03; 285/261; 4/570

(58) Field of Classification Search
USPC ..... 137/119.03, 119.06; 4/570, 601, 4/604, 605, 614, 612; 285/51, 121.7, 146.1, 285/261
See application file for complete search history.

(56) References Cited

U.S. PATENT DOCUMENTS 2,867,230 A * 1/1959 Bletcher et al. ..... 4/615
3,375,532 A * 4/1968 Gellmann ..... 4/570
7,043,776 B1 * 5/2006 Wu ..... 4/601
7,918,424 B1 * 4/2011 Wu et al. ..... 248/222.11
8,191,185 B2 * 6/2012 Tsai ..... 4/601

* cited by examiner

*Primary Examiner* — John K Fristoe, Jr.
*Assistant Examiner* — Reinaldo Sanchez-Medina

(57) ABSTRACT

A mounting mechanism of a shower equipment is provided. An adjusting device is mounted between a vertical supporting tube and a connector connected to a head shower, wherein the supporting tube is connected to a mounting base equipped with a faucet. One end of a lower joint pipe is connected to the supporting tube and the other end is mounted to an interior of a ball valve. A guiding base is located above the ball valve and formed with a ball-shaped slot for receiving the ball valve. One end of an upper joint pipe is connected to and received in an outer base so that the bottom of the end appropriately presses against the guiding base and the other end is connected to the connector. Whereby, in fabricating the shower equipment, it needs only to adjust the supporting tube without any additional device or hand tool.

3 Claims, 5 Drawing Sheets

MOUNTING MECHANISM OF A SHOWER EQUIPMENT

BACKGROUND OF THE INVENTION

1. Field of the Invention

The present invention relates to a shower equipment, particularly, to a mounting mechanism of a shower equipment.

2. Description of the Prior Art

Conventional bath equipment such as bathtub is nowadays replaced by shower equipment. A conventional shower equipment is usually composed of a faucet and a hand shower, in which a hose connects the faucet and the hand shower, so that an user can hold the hand shower by hand to take a shower.

Recently, conventional shower equipment is changed to include a head shower. A lower end of a supporting tube is connected to a faucet, a base is laterally mounted to a middle portion of the supporting tube, and an upper end of the supporting tube communicates with one end of a passage, the other end of the passage is connected to a lateral connecting tube, a distal end of the connecting tube is connected to the head shower. Water sprays out from the head shower in an up-to-down manner and is formed into densely long and thin water silks that are distributed in a larger area. The head shower is fixedly disposed at a position which is above the head of an user. Unlike the hand shower, the head shower provides other options for users.

Although the conventional shower equipment can be provided with advantages of the head shower and the hand shower, a problem still exists. Since the passage communicating with the head shower is far away from a mounting base connected with the faucet, the assembly of the shower equipment will be obstructed if pipe members and control valve disposed in the passage are not kept substantially parallel to a fixing base, such that the supporting tube is hard to be exactly vertically mounted. Thus, the mounting base laterally connected to the faucet is thereby hard to be mounted due to the non-vertically mounted supporting tube, resulting in a difficult fabrication.

The present invention is, therefore, arisen to obviate or at least mitigate the above mentioned disadvantages.

SUMMARY OF THE INVENTION

The main object of the present invention is to provide a shower equipment which is mounted with an adjustable mechanism, so as to ensure that a supporting tube can be adjusted according to a connecting tube connected a head shower so that the supporting tube is exactly vertically mounted, thus facilitating the fabrication of the supporting tube and pipes laterally connected thereto.

To achieve the above and other objects, a mounting mechanism of a shower equipment of the present invention is provided, wherein one end of a supporting tube is connected to a mounting base equipped with a faucet, the other end of the supporting tube is connected to a head shower, the head shower is communicated with a connecting tube, a three-way connector is communicated with and between the connecting tube and the supporting tube, and an adjusting device is mounted between the connector and the supporting tube. The mounting mechanism includes an outer base, a lower joint pipe, a ball valve, a guiding base, and an upper joint pipe. The outer base is an annular body. The lower joint pipe includes a first connecting end, a second connecting end, and the first connecting end is connected to one end of the supporting tube. An interior of the ball valve is adapted to be connected with the second connecting end of the lower joint pipe, so that the ball valve is connected to the supporting tube via the lower joint pipe. The guiding base is a hollow annular body and located above the ball valve, one end of the guiding base has an inner sidewall and is formed with a ball-shaped slot for receiving the ball valve, the inner sidewall correspondingly contacts the ball valve, and the other end of the guiding base is formed with an engaging portion. The upper joint pipe includes a first connecting end, a second connecting end, the first connecting end is connected to and received in the outer base for the bottom of the first connecting end appropriately pressing against the guiding base so that the inner sidewall contacts the ball valve, and the second connecting end is connected to the connector.

In the invention, the adjusting device is mounted between the connecting tube and the supporting tube, so that if the connecting tube and the connector are non-horizontally mounted and stand tilt, the supporting tube connected to the ball valve can be adjusted to rotate around the ball valve to stand vertical since the ball valve and the guiding base are cooperate in a relative slidable rotation relationship. That is, the non-horizontally mounted connecting tube and connector would not affect the fabrication of the connector and members connected thereto. Through adjusting the supporting tube to stand substantially vertical, it can be ensured that the mounting base below the supporting tube is kept horizontal without any fabrication obstruction or limitation resulted from the tilt of the connector and the head shower. Hence, the fabrication can proceed without any obstruction or limitation and the fabrication time can be saved. Besides, the mounting base and the faucet can be kept horizontal, the supporting tube can be kept vertical, and thus it is much utility.

Additionally, in fabricating the shower equipment, it needs only to adjust the supporting tube slidably rotatably disposed around the ball valve but without any additional device or hand tool.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
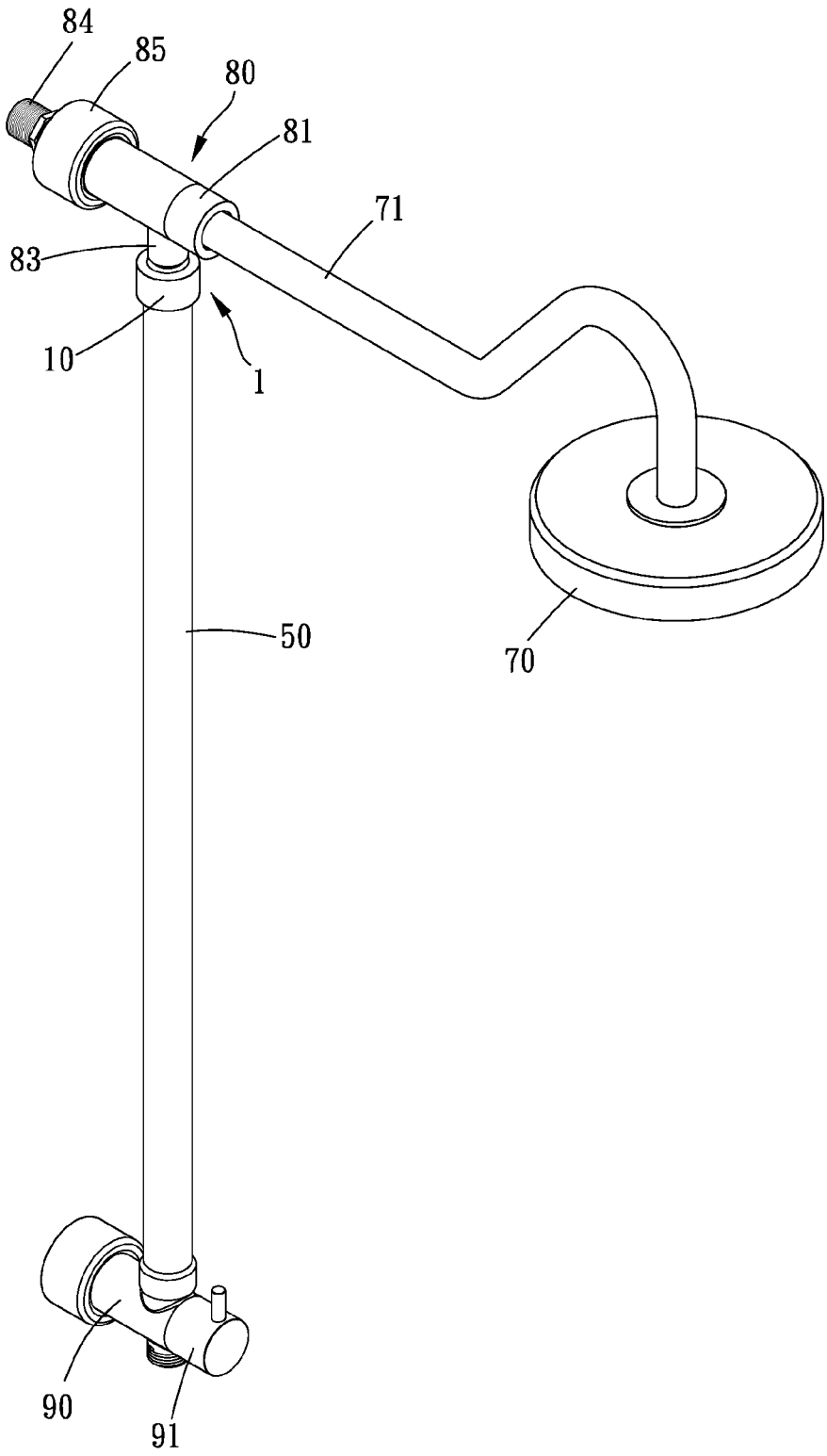
FIG. 1 is a perspective view of a shower equipment according to a preferable embodiment of the present invention.

As shown in FIG. 1, a mounting mechanism of a shower equipment of the present invention is provided. One end of a supporting tube 50 is connected to a mounting base 90 equipped with a faucet 91, the other end of the supporting tube 50 is adapted to be connected to a head shower 70. The head shower 70 is connected with a lateral connecting tube 71 and a substantially T-shaped connector 80. The T-shaped connector 80 includes a first pipe end 81 for being connected to the connecting tube 71, a horizontal second pipe end 82 and a vertical third pipe end 83. An adjusting device 1 is mounted between the third pipe end 83 and the supporting tube 50.

Figure 4:
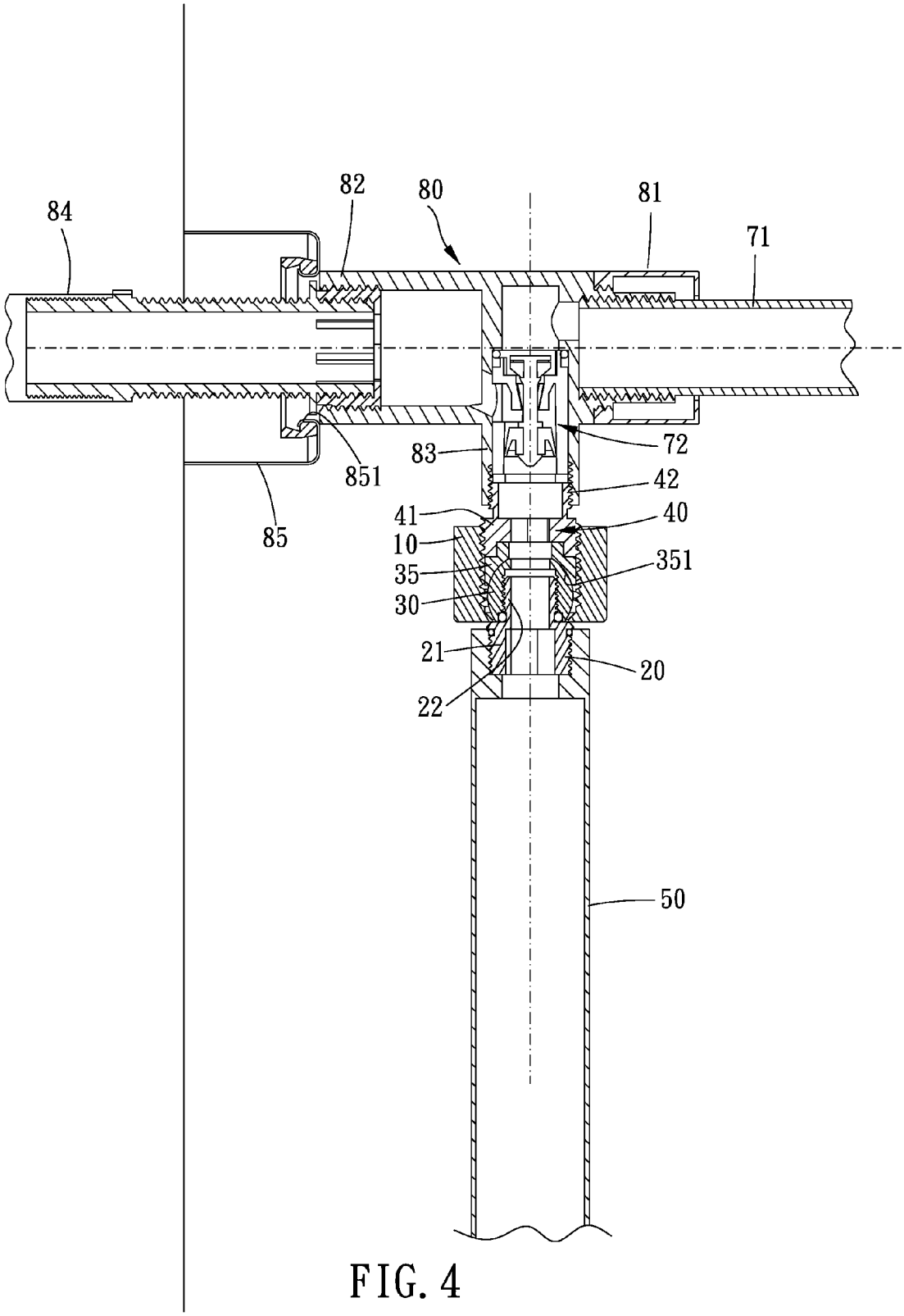
FIG. 4 is a drawing showing an adjusting device according to the preferable embodiment of the present invention.

As shown in FIG. 4, the second pipe end 81 is adapted to be connected with a linking pipe 84 which is fixedly fitted into an outlet hole 851 of a sidewall connector 85 mounted onto a wall. A control valve 72 is mounted in the connector 80 and among the first, second and third pipe ends 81 82 83. When a valve body 92 inside the faucet 91 is in a closed position, the control valve 72 is pushed away by hydraulic pressure to form a passage permitting the water from the linking pipe 84 to flow through the first pipe end 81 and the connecting tube 71 and to the head shower 70. The control valve 72, herein, may be considered as a well-known device, and it is therefore not described in detail.

Figure 2:
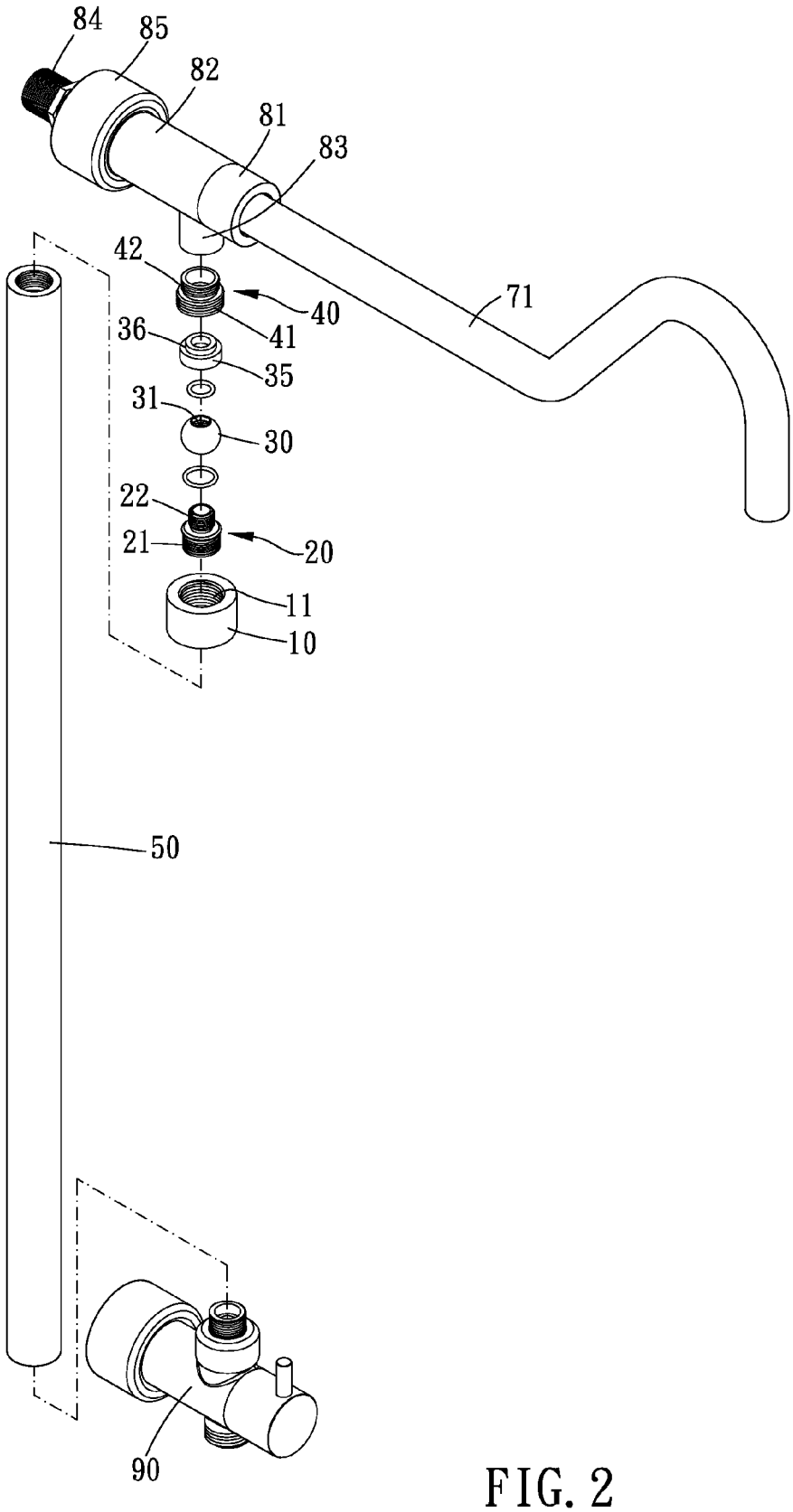
FIG. 2 is a perspective breakdown drawing of the shower equipment according to the preferable embodiment of the present invention.
Figure 3:
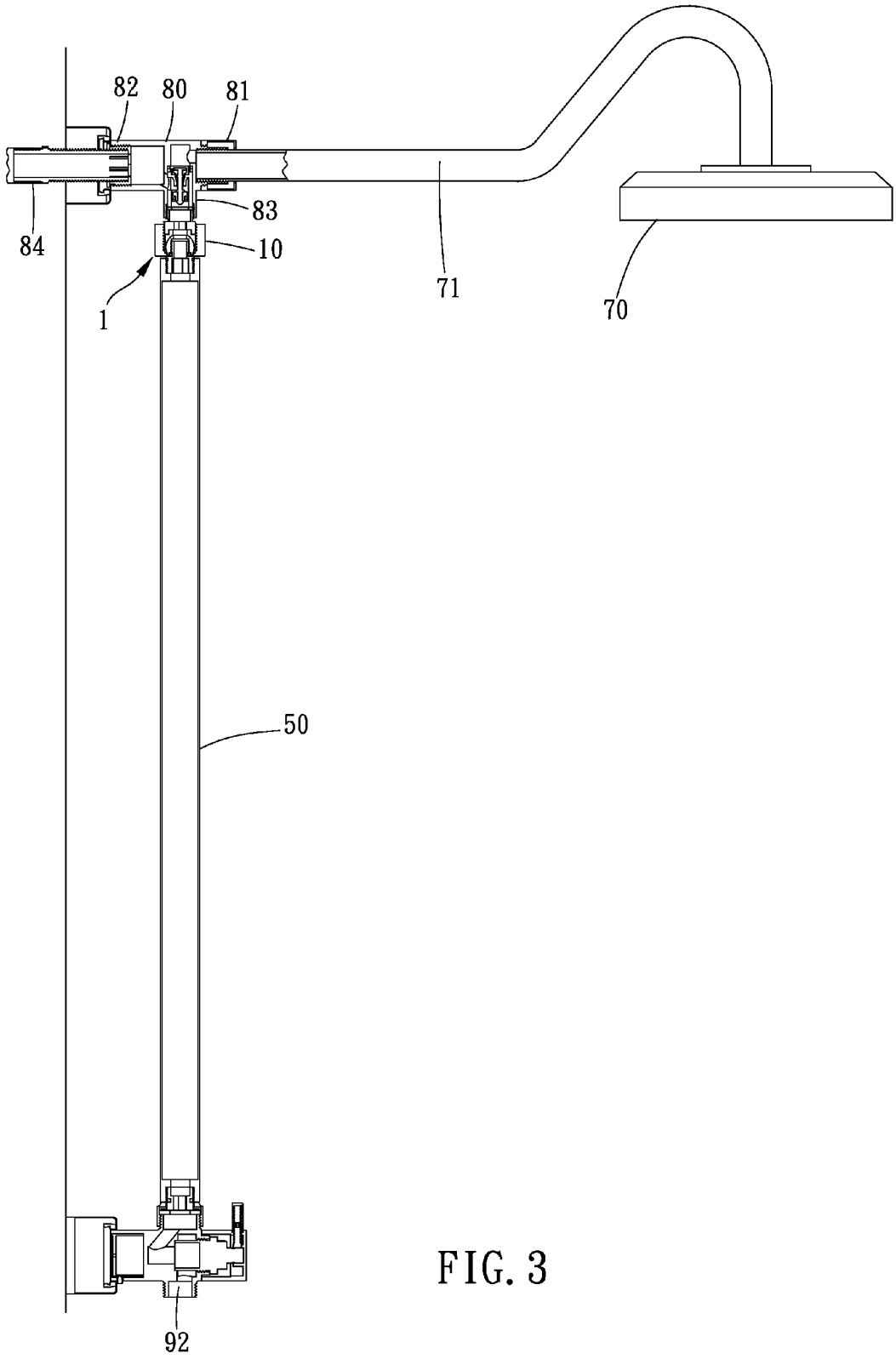
FIG. 3 is a cross-sectional view of the shower equipment according to the preferable embodiment of the present invention.

As shown in FIGS. 2 and 4, the adjusting device 1 includes an outer base 10, a lower joint pipe 20, a ball valve 30, a guiding base 35 and an upper joint pipe 40.

The outer base 10 has an inner thread 11 therein and is an annular body. The lower joint pipe 20 includes a first connecting end 21 and a second connecting end 22, and the first connecting end 21 is screwed and fitted into one end of the supporting tube 50. The ball valve 30 is formed with an inner connecting hole 31 having an inner thread, and the second connecting end 22 is screwed and connected to the ball valve 30 and located in the inner connecting hole 31. The guiding base 35 is a hollow annular body and located above ball valve 30. An end of the guiding base 35, corresponding to the ball valve 30, is formed with a concave ball-shaped slot 351, and the other end of the guiding base 35 is formed with a protruding engaging portion 36 having a smaller outer diameter. The upper joint pipe 40 includes a first connecting end 41 and a second connecting end 42. The first connecting end 41 is connected and received in the outer base 10 via its outer thread being screwed with inner thread 11, such that the bottom of the first connecting end 41 appropriately presses against the engaging portion 36 of the guiding base 35 and the inner sidewall in the ball-shaped slot 351 of the guiding base 35 contacts the outer surface of the ball valve 30. The second connecting end 42 is adapted to be connected and received in the third pipe end 83 of the connector 80.

In the invention, the first connecting end 21 of lower joint pipe 20 is connected to the top end of the supporting tube 50, the second connecting end 22 is connected to the ball valve 30 and received in the inner connecting hole 31, the inner surface in the ball-shaped slot 351 of the guiding base 35 contacts against the outer surface of the ball valve 30, the outer base 10 is adapted for receiving the above-mentioned members, the first connecting end 41 of the upper joint pipe 40 can be detachably connected to the outer base 10, such that the threading connection strength of the outer thread of the upper joint pipe 40 and the inner thread 11 of the outer base 10 can ensure that the inner surface in the ball-shaped slot 351 of the guiding base 35 contacts against the outer surface of the ball valve 30 and the guiding base 35 is kept slidable and rotatable around the ball valve 30, and the second connecting end 42 of the upper joint pipe 40 is connected to the third pipe end 83 of the connector 80, and thus the fabrication of the invention is completed.

As shown in FIG. 4, if there is no obstruction in mounting a shower equipment, namely, the second pipe end 82 of the connector 80 and the linking pipe 84 are substantially horizontally mounted to the sidewall connector 85, the mounting base 90 and the faucet 91 (FIG. 1) can be substantially horizontally mounted to a wall too, such that the supporting tube 50 can be kept standing substantially vertical.

Figure 5:
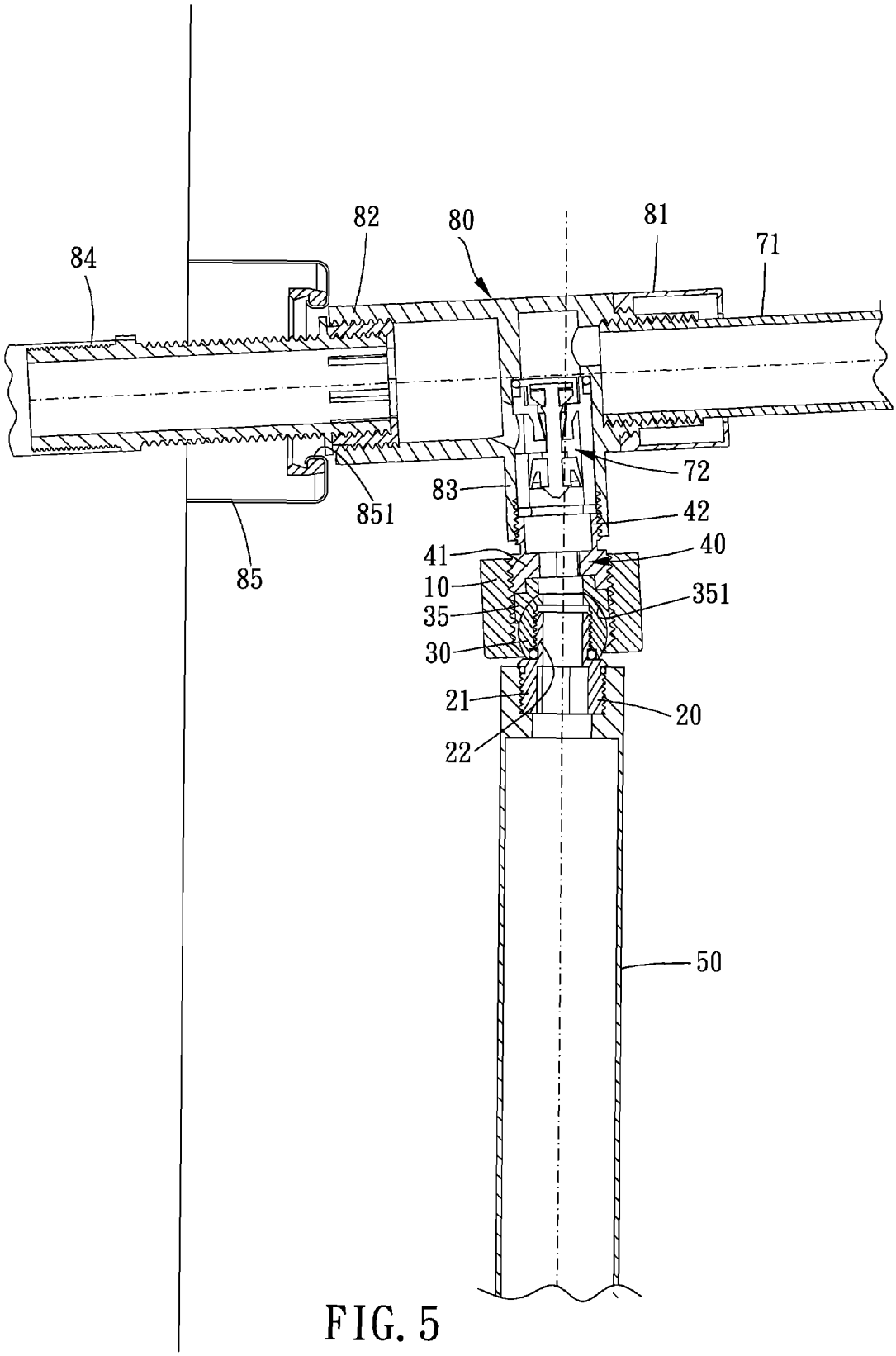
FIG. 5 is a drawing showing the adjusting device after being adjusted according to the preferable embodiment of the present invention.

As shown in FIG. 5, if there is any obstruction such as an uneasy mounting of the shower equipment or a tilt of the connector 80 in mounting the shower equipment, the second connecting end 42 of the upper joint pipe 40 and the guiding base 35 are also tilt accordingly due to the tilt of the third pipe end 83 connected to the first connecting end 41, for example. Hence, the ball valve 30 together with the supporting tube 50 connected to the lower joint pipe 20 can be adjusted to desired location by the worker, wherein the spherical outer surface of the ball valve 30 slidly rotates in the ball-shaped slot 351 of the guiding base 35 and the supporting tube 50 can be adjusted to stand vertical, such that the supporting tube 50 can also be smoothly connected to the substantially horizontal mounting base 90 without any obstruction. Therefore, the adjusting device 1 allows to adjust the supporting tube 50 by hand but without any additional device or hand tool, and the location of the supporting tube 50 can be adjusted via the guiding base 35 rotating around the ball valve 30, so that the adjusting range of the supporting tube 50 is expanded and flexible and a lightly-adjusted movement can be precisely controlled, and thus it is much utility.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A mounting mechanism of a shower equipment, one end of a supporting tube being connected to a mounting base equipped with a faucet, the other end of the supporting tube being connected to a head shower, the head shower being communicated with a connecting tube, a three-way connector being communicated with and between the connecting tube and the supporting tube, an adjusting device being mounted between the connector and the supporting tube, and the mounting mechanism including an outer base, a lower joint pipe, a ball valve, a guiding base, and an upper joint pipe, wherein:

the outer base is an annular body;

the lower joint pipe includes a first connecting end and a second connecting end, and the first connecting end is connected to one end of the supporting tube;

an interior of the ball valve is adapted to be connected with the second connecting end of the lower joint pipe, so that the ball valve is connected to the supporting tube via the lower joint pipe;

the guiding base is a hollow annular body and located above the ball valve, one end of the guiding base has an inner sidewall and is formed with a ball-shaped slot for receiving the ball valve, the inner sidewall correspondingly contacts the ball valve, and the other end of the guiding base is formed with an engaging portion;

the upper joint pipe includes a first connecting end and a second connecting end, the first connecting end is connected to and received in the outer base for the bottom of the first connecting end appropriately pressing against the guiding base so that the inner sidewall contacts the ball valve, and the second connecting end is connected to the connector.

2. The shower equipment of claim 1, wherein the connector includes a first pipe end for being connected to the connecting tube, a second pipe end and third pipe end, the first and second connecting ends of the upper joint pipe are formed with outer threads respectively, the outer base is formed with an inner thread, the second connecting end of the upper joint pipe is screwed and connected to the third pipe end, and the outer base is screwed and connected to the first pipe end of the upper joint pipe.

3. The shower equipment of claim 1, the first and second connecting ends of the lower joint pipe are formed with outer threads respectively, an interior of the ball valve is formed with an inner connecting hole, and the second connecting end of the lower joint pipe is screwed and connected to the ball valve and located in the inner connecting hole.

* * * * *